US009677209B2

(12) United States Patent
Daube et al.

(10) Patent No.: US 9,677,209 B2
(45) Date of Patent: Jun. 13, 2017

(54) KNITTED FABRIC, METHOD FOR PRODUCING A KNITTED FABRIC, AND WARP KNITTING MACHINE

(71) Applicant: KARL MAYER TEXTILMASCHINENFABRIK GmbH, Obertshausen (DE)

(72) Inventors: Vera Daube, Obertshausen (DE); Rainer Kemper, Heusenstamm (DE); Michael Kieren, Rodgau (DE); Oliver Mathews, Seligenstadt (DE)

(73) Assignee: KARL MAYER TEXTILMASCHINENFABRIK GmbH, Obertshausen (DE)

( * ) Notice: Subject to any disclaimer, the term of this patent is extended or adjusted under 35 U.S.C. 154(b) by 180 days.

(21) Appl. No.: 14/606,426

(22) Filed: Jan. 27, 2015

(65) Prior Publication Data

US 2015/0376823 A1 Dec. 31, 2015

(30) Foreign Application Priority Data

Jun. 26, 2014 (DE) ..... 10 2014 108 987

(51) Int. Cl.
*D04B 21/14* (2006.01)
*D04B 21/20* (2006.01)
*D04B 23/00* (2006.01)

(52) U.S. Cl.
CPC ..... *D04B 21/14* (2013.01); *D04B 21/20* (2013.01); *D04B 23/00* (2013.01);
(Continued)

(58) Field of Classification Search
CPC ..... D04B 21/02; D04B 23/02; D04B 23/08; D04B 27/08
(Continued)

(56) References Cited

U.S. PATENT DOCUMENTS 4,332,149 A * 6/1982 Mayer ..... D04B 23/02 66/87
4,785,558 A * 11/1988 Shiomura ..... A43B 1/04 36/114
(Continued)

FOREIGN PATENT DOCUMENTS

DE 41 40 826 6/1993
DE 299 17 208 9/2000
(Continued)

OTHER PUBLICATIONS

Korea Office Action conducted in counterpart Korea Appln. No. 10 2015 0032768 (Apr. 29, 2016) (w/ English language translation).
(Continued)

*Primary Examiner* — Danny Worrell
(74) *Attorney, Agent, or Firm* — Greenblum & Bernstein, P.L.C.

(57) ABSTRACT

A knitted fabric, a method of producing the knitted fabric and a warp knitting machine. The knitted fabric includes a first covering layer; a second covering layer; and an arrangement of pile threads formed as spacer threads between the first covering layer and the second covering layer. Each covering layer includes multiple stitch rows arranged one after another. The spacer threads have different lengths, and the spacer threads woven into each stitch row have equal lengths. The spacer threads in a first width region have a different length than the spacer threads in a second width region. For at least two adjacent stitch rows, one stitch row is connected to spacer threads of a first length in the first width region and one stitch row is connected to spacer threads of a second length in the second width region.

14 Claims, 1 Drawing Sheet

(52) U.S. Cl.
CPC ..... *D10B 2403/0221* (2013.01); *D10B 2403/0222* (2013.01); *D10B 2501/043* (2013.01)

(58) Field of Classification Search
USPC ..... 66/203, 208
See application file for complete search history.

(56) References Cited

U.S. PATENT DOCUMENTS 4,787,219 A * 11/1988 Sato ..... B29C 70/24 66/190
5,385,036 A * 1/1995 Spillane ..... A43B 1/04 2/16
5,651,847 A * 7/1997 Loeffler ..... D04B 1/16 29/91.1
5,896,758 A * 4/1999 Rock ..... A43B 1/04 66/191
6,156,406 A * 12/2000 Rock ..... B32B 5/12 428/86
6,755,052 B1 * 6/2004 Sytz ..... D04B 1/18 66/19
6,915,666 B2 * 7/2005 Willmer ..... D04B 9/06 66/19
7,849,715 B2 * 12/2010 Starbuck ..... A41C 3/0014 66/171
7,913,520 B1 * 3/2011 Chen ..... D04B 1/16 66/195
8,491,514 B2 * 7/2013 Creighton ..... A61F 13/10 602/60
2015/0376823 A1 * 12/2015 Daube ..... D04B 21/14 66/195

FOREIGN PATENT DOCUMENTS

DE 10 2008 047 684 3/2010
JP 2003-013346 1/2003
JP 2005-002490 1/2005
KR 10-1998-0063868 10/1998

OTHER PUBLICATIONS

German Office Action conducted in counterpart German Appln. No. 10 2014 108 987.1 (Mar. 25, 2015) (w/ English language translation).

* cited by examiner

KNITTED FABRIC, METHOD FOR PRODUCING A KNITTED FABRIC, AND WARP KNITTING MACHINE

CROSS-REFERENCE TO RELATED APPLICATIONS

The present application claims priority under 35 U.S.C. §119 of German Patent Application No. 10 2014 108 987.1, filed Jun. 26, 2014, the disclosure of which is expressly incorporated by reference herein in its entirety

BACKGROUND OF THE INVENTION

1. Field of the Invention

Embodiments of the invention relates to a knitted fabric having a first covering layer, a second covering layer and an arrangement of pile threads embodied as spacer threads between the first covering layer and second covering layer. Each covering layer includes multiple stitch rows arranged one after another, spacer threads are provided with different lengths, and spacer threads of equal length are woven into each stitch row.

Furthermore, embodiments of the invention relate to a method for producing a knitted fabric in which a first covering layer is produced with a series of first stitch rows arranged one after another in the direction of production and a second covering layer is produced with a series of second stitch rows arranged one after another in the direction of production and in which pile threads are arranged between the two covering layers as spacer threads and woven into the covering layers. A distance between the covering layers is altered and regions with varyingly long spacer threads are produced.

Further embodiments relate to a warp knitting machine having two knitting regions for producing respectively one covering layer. The distance between the knitting regions can be adjusted by an actuating drive, and having at least one pile guide bar which can be moved with its guide needles back and forth between the knitting regions.

2. Discussion of Background Information

Knitted fabrics with two covering layers between which spacer threads are arranged are also referred to as "knitted spacer fabrics." A knitted spacer fabric of this type has, for example, relatively good air permeability so that for products that are used in connection with the human body, it is preferably used where the wicking-away of moisture is desired. Examples thereof are chair upholsteries, mattresses or backpack straps.

In the simplest case, a knitted spacer fabric of this type has a constant thickness. In this case, the knitted fabric is produced with the aid of two needle heads which have an unchanging and constant distance to one another. Between the two needle heads, at least one pile guide bar is disposed which arranges the pile threads between the covering layers as spacer threads.

In order to have greater freedom in the design of the knitted fabric, it is known from German Patent Application No. DE 10 2008 047 684 A1, for example, to alter the distance between the needle heads by an actuating drive. The distance can also be altered during the manufacture or production of the knitted fabric. However, this change in distance is always linked to a change in thickness of the knitted fabric over the entire width thereof.

A similar approach is known from U.S. Pat. No. 7,913, 520 B1.

A knitted fabric having a thickness that can also be variably selected in the width direction is known from DE 41 40 826 A1. However, for this purpose, it is necessary to divide at least one or a number of the bars which carry the knitting tools. This makes a control, and therefore an operation, of the warp knitting machine extraordinarily complicated.

SUMMARY OF THE INVENTION

Accordingly, embodiments of the invention allow for greater freedom in the design of the knitted fabric with little effort.

Embodiments are directed to a knitted fabric of the type named at the outset in that spacer threads in a first width region have a different length than spacer threads in a second width region and in that, of at least two adjacent stitch rows, one stitch row is only connected to spacer threads of a first length in the first width region and one stitch row is only connected to spacer threads of a second length in the second region.

A knitted fabric of this type can have different thicknesses in the width direction. The thickness of the knitted fabric is determined by the length of the spacer threads. If, in a first width region, there are threads shorter than in a second width region, then the first width region is embodied or formed thinner than the second width region. Of course, it is also possible to embody or form a third, fourth, etc. width region with different thicknesses in an analogous manner. However, the spacer threads in the width regions with different thicknesses are not arranged in the same stitch row. Instead, the spacer threads in the first width region are displaced from the spacer threads in the second width region in the direction of production. However, this is not problematic since sufficient stability of the knitted spacer fabric is also ensured if spacer threads are only arranged in every second, third etc. stitch row.

Preferably, stitch rows with spacer threads of the first length and stitch rows with spacer threads of the second length alternate with one another. Initially, this does not require that the stitch rows connected to varyingly long spacer threads directly alternate with one another. It is also possible to respectively connect two or three stitch rows in succession to equally long spacer threads. A direct alternation is preferred, however. In this case, the two covering layers are ideally supported against one another by the spacer threads.

Preferably, a transition region is provided between the first width region and the second width region, which transition region is free of spacer threads. The thickness changes in the transition region. This can be achieved in a simple manner in that no spacer threads are present there.

In an alternative embodiment, it is provided that a transition region is provided between the first width region and the second width region, in which transition region spacer threads with the greater of the two lengths are arranged. In this case the spacer threads are laid while the two covering layers have the greater distance between one another. If a decrease in the thickness then occurs as a result of adjacent spacer threads of a lesser length, then the spacer threads in the transition region are compressed slightly.

Preferably, the pile threads are respectively woven into a covering layer in regions in which the pile threads do not connect the two covering layers. They then do not cause any further disturbance and can also no longer be seen.

Preferably, at least in one predetermined length section of the knitted fabric, each stitch row includes a width section that is free of spacer threads. In this width section, the spacer threads are then only arranged in other stitch rows and can thus determine a different thickness of the knitted fabric.

Embodiments of the invention are directed to a method of the type named at the outset in which spacer threads are only woven in within a first width region at a first distance between the covering layers and spacer threads are only woven in within a second width region at a second distance between the covering layers.

Thus, varyingly thick width regions occur in the width direction of the knitted fabric. The length of the spacer threads results automatically from the distance between the covering layers at the moment when the spacer threads are woven in. Because the spacer threads are not woven in over the entire width of the knitted fabric when there are different thicknesses of the knitted fabric in the width direction, varying thicknesses in the width direction can be simply produced in that, in a stitch row with a predetermined distance between the covering layers, the stitch threads are only woven in where this distance is subsequently also to be maintained. Accordingly, in the other width regions, no spacer threads are woven into the stitch rows. In order to also provide spacer threads in those locations, the spacer threads are woven into a different stitch row there. A continuous pile guide bar can be used in which it merely needs to be possible to control the individual needles such that they either weave the pile threads into both covering layers in order to produce spacer threads, or such that they only weave the pile threads into one covering layer, or not at all, in order to form a stitch row without spacer threads in a particular width region. This can be achieved without any problems using jacquard bars, with which the guide needles can be individually controlled.

Preferably, switching occurs between the first distance and the second distance. It is thus possible, for example, to provide a short length region having a number of stitch rows with spacer threads of a first length in a first width region and to provide subsequent stitch rows with spacer threads of a second length in another width region.

However, it is preferred that, at least on a predetermined length section of the knitted fabric, a different distance between the covering layers is set for each new stitch row. The spacer threads are thus arranged relatively uniformly between the covering layers.

At least in the predetermined length section, one width section is preferably embodied or formed without spacer threads in each stitch row. In the stitch row which has been formed without spacer threads in a first width section, spacer threads are then only present in a second width region. In this width region, the thickness of the knitted fabric is then determined by the spacer threads in this stitch row. The thickness of the knitted fabric in a different width region is then determined by the length of the spacer threads in a different width section.

Preferably, pile threads that are not used as spacer threads in a width region are carried along in a covering layer. These pile threads are then not visible and also do not create any further disturbance.

Embodiments are directed to a warp knitting machine of the type named at the outset in which the pile guide bar is embodied or formed as a jacquard guide bar, the guide needles of which are adjustable between a working position and a resting position. A control device is provided which adjusts the guide needles depending on the spacing of the knitted fabric.

A jacquard guide bar is known per se. It most cases, it can be moved in a displacement direction, that is, in the direction of its longitudinal extension, during the production of the knitted fabric. However, the guide needles can be adjusted individually, so that they move, for example, counter to the displacement of the guide bars and thus remain in place. In this case, a weaving of the pile threads into a covering layer is avoided.

Preferably, the control device also controls the actuating drive. Therefore, no separate sensors are necessary for the distance between the knitting regions. Instead, the control device "knows" which distance is present for a particular stitch row. Accordingly, it can control the corresponding jacquard guide needles as a function of this distance. These guide needles can, for example, include a piezoelectric drive.

Embodiments of the invention are directed to a knitted fabric that includes a first covering layer; a second covering layer; and an arrangement of pile threads formed as spacer threads between the first covering layer and the second covering layer. Each covering layer includes multiple stitch rows arranged one after another. The spacer threads have different lengths, and the spacer threads woven into each stitch row have equal lengths. The spacer threads in a first width region have a different length than the spacer threads in a second width region. For at least two adjacent stitch rows, one stitch row is connected to spacer threads of a first length in the first width region and one stitch row is connected to spacer threads of a second length in the second width region.

In embodiments, for at least two adjacent stitch rows, one stitch row is only connected to spacer threads of a first length in the first width region and one stitch row is only connected to spacer threads of a second length in the second width region.

According to embodiments of the invention, stitch rows having spacer threads of the first length and stitch rows having spacer threads of the second length may alternate with one another.

In accordance with other embodiments, the knitted fabric can include a transition region arranged between the first width region and the second width region, which can be free of spacer threads.

Further, the knitted fabric may also include a transition region arranged between the first width region and the second width region, in which spacer threads having a length of a greater of the different lengths can be arranged.

In still other embodiments, the pile threads may be respectively woven into one of the covering layers in regions in which the pile threads do not connect the two covering layers.

According to further embodiments, at least in one predetermined length section of the knitted fabric, each stitch row can include a width section that is free of spacer threads.

Embodiments of the invention are directed to a method for producing a knitted fabric. The method includes producing a first covering layer with a series of first stitch rows arranged one after another in a direction of production and a second covering layer with a series of second stitch rows arranged one after another in the direction of production; and weaving pile threads arranged between the two covering layers into the covering layers as spacer threads. A distance between the covering layers is not constant and regions having different length spacer threads are produced. The spacer threads are woven into a first width region at a first distance between the covering layers and the spacer threads are woven into a second width region at a second distance between the covering layers.

According to embodiments, the spacer threads are only woven into a first width region at a first distance between the covering layers and the spacer threads are only woven into a second width region at a second distance between the covering layers.

In embodiments, alternation can occur between the first distance and the second distance.

According to other embodiments, at least on one predetermined length section of the knitted fabric, a different distance between the covering layers may be set for each new stitch row.

In accordance with still other embodiments, at least in the predetermined length section, one width section can be formed without spacer threads in each stitch row.

In further embodiments, pile threads which are not used as spacer threads in a width section may be carried along in a covering layer.

Embodiments of the invention are directed to a warp knitting machine that includes two knitting regions structured and arranged for producing respective one covering layers; an actuating drive structured and arranged to adjust a distance between the knitting regions; at least one pile guide bar having guide needles, the at least one pile guide bar being movable with the guide needles back and forth between the knitting regions; and a control device structured and arranged to adjust the guide needles depending on the distance between the knitting regions.

In embodiments, the at least one pile guide bar can be formed as a jacquard guide bar, the guide needles of which can be adjustable between a working position and a resting position.

In accordance with still yet other embodiments of the present invention, the control device can be further structured to control the actuating drive.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
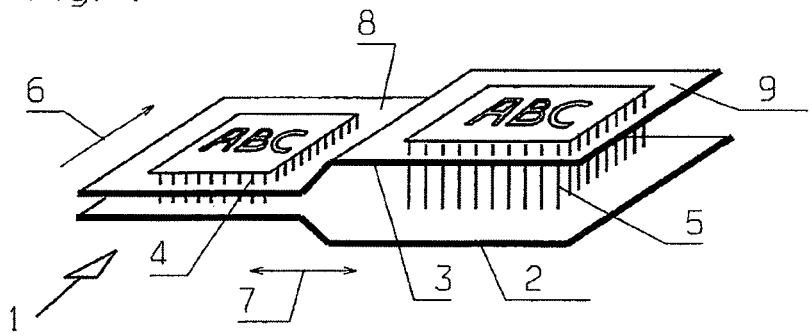
FIG. 1 shows a perspective representation of knitted fabric.

A knitted fabric 1 illustrated in FIG. 1 comprises a first covering layer 2 and a second covering layer 3. Spacer threads 4, 5 are arranged between two covering layers 2, 3. Spacer threads 4, 5 are pile threads which connect the two covering layers 2, 3 to one another. The spacer threads 4, 5 are thus woven into the two covering layers 2, 3. For the purpose of illustration, a direction of production 6 is also represented by an arrow. A width direction 7 illustrated by a double arrow runs transversely to direction of production 6. It can be seen that knitted fabric 1 comprises in width direction 7 a first width region 8 having a lesser thickness and a second region 9 having a greater thickness. In the exemplary embodiment illustrated here, first width region 8 has a thickness of 3 mm and second width region 9 has a thickness of 5 mm.

Figure 2:
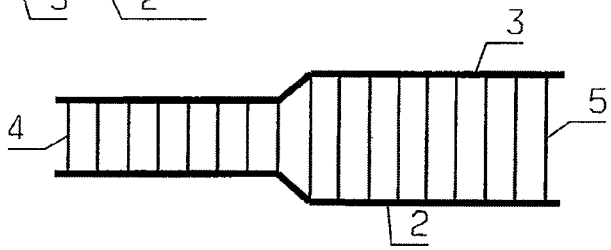
FIG. 2 shows a sectional view of the knitted fabric.

FIG. 2 shows a sectional representation through knitted fabric 1. Identical elements are provided with the same reference numerals.

Embodiments of the invention produce knitted fabric of this type with the smallest possible effort.

Figure 4:
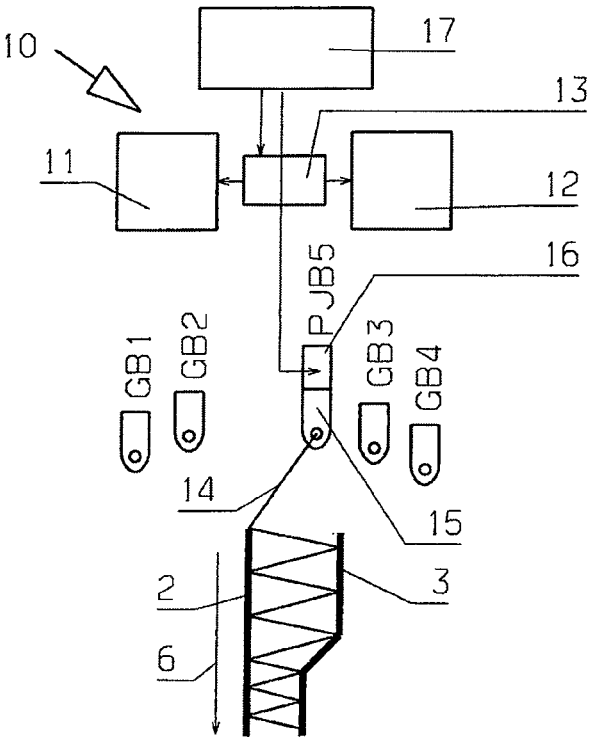
FIG. 4: shows a highly schematized representation for the purpose of illustrating a warp knitting machine.

A warp knitting machine 10 used for this purpose is illustrated in FIG. 4 in a highly schematized form. Warp knitting machine 10 comprises a first weaving area 11 which comprises two ground guide bars GB1, GB2. Furthermore, in a manner not illustrated in greater detail, additional elements can be provided, in particular, a knitting needle bar and a comb plate.

Furthermore, warp knitting machine 10 comprises a second knitting region 12, of which two ground guide bars GB3, GB4 are illustrated here.

Knitting region 11 produces covering layer 2. Knitting region 12 produces covering layer 3.

Furthermore, an actuating drive 13 is provided with which the distance between the two knitting regions 11, 12 can also be adjusted during operation of warp knitting machine 10. The distance between the two knitting regions 11, 12 at a particular point in time typically defines the thickness of knitted fabric 1 that has been produced at said point in time.

Pile guide bar PJB5 serves to guide pile threads 14 back and forth between the two covering layers 2, 3 as spacer threads 4, 5 and to also weave them into covering layers 2, 3 when this is necessary. This is explained below.

Of course, multiple pile threads 14 of this type are provided perpendicularly to the drawing plane.

Pile guide bar PJB5 can be moved in the displacement direction, that is, parallel to its longitudinal extension. It comprises guide needles 15 that can be individually controlled by a piezo drive 16, for example, counter to the displacement movement of pile guide bar PJB5. If piezo drive 16 is actuated during a displacement movement of pile guide bar PJB5, then guide needle 15 remains stationary as it were. If piezo drive 16 is not actuated, then guide needle 15 is also moved in the displacement direction and can therefore participate in a stitch-formation process. Only by a stitch-formation process is it possible to weave pile thread 14 into covering layer 2 or into covering layer 3.

Piezo drive 16 is controlled by a control device 17. Control device 17 also controls actuating drive 13, which determines the distance between the two knitting regions 11, 12.

Control device 17 thus "knows" which distance is present between the two knitting regions 11, 12 during a stitch-formation operation. Accordingly, control device 17 also "knows" which distance is present between the two covering layers 2, 3 at a particular moment in which pile threads 14 are to be laid as spacer threads.

Figure 3:
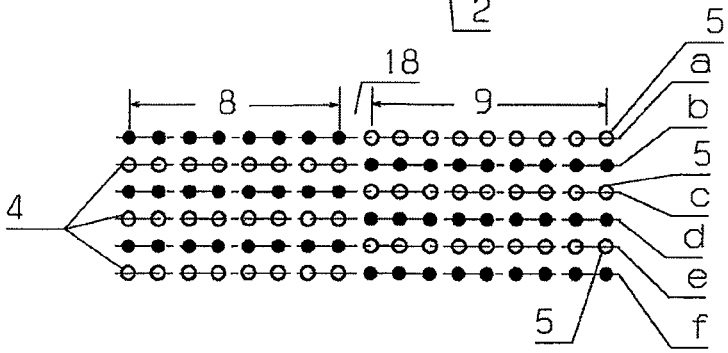
FIG. 3 shows a schematic representation of the arrangement of spacer threads.

In order to achieve the different distances between covering layers 2, 3 in width direction 7, an approach is used such as is described on the basis of FIG. 3. FIG. 3 shows a series of stitch rows a, b, c, d, e, f. The series of stitch rows a-f forms, for example, covering layer 2. All stitches of a stitch row of covering layer 2 or of the covering layer 3 are produced simultaneously.

In stitch rows a-f, positions are represented by a small circle. In these positions, pile threads 14 are woven into both covering layers 2, 3. Furthermore, positions are represented by dots in stitch rows a-f. Here, pile threads 14 are not woven into respective covering layers 2, 3.

On the basis of FIG. 3, it can be seen that in width region 8, pile threads 14 are only woven into covering layers 2, 3 as spacer threads 4 at every second stitch row b, d, f. In contrast, no spacer threads 4 are provided in the other stitch rows a, c, e. At the moments in which the stitch rows b, d, f are produced, the two knitting regions 11, 12 have the lesser distance of 3 mm, for example. Accordingly, spacer threads 4 also have a length of 3 mm.

In width region 9, the respectively other stitch rows a, c, e are provided with spacer threads 5 which have been woven into the two covering layers 2, 3. However, stitch rows b, d, f do not have any spacer threads. At the moments in which stitch rows a, c, e are produced, the two knitting regions 11, 12 have a greater distance between them of 5 mm, for example. Accordingly, spacer threads 5 then also have a length of 5 mm.

Control device 17 controls both actuating drive 13, with which the distance between the two knitting regions 11, 12 can be adjusted, and also piezo drive 16 of pile guide bar PJB5. Accordingly, it is possible in a simple manner to only weave spacer threads 4 into stitch rows b, d, f of covering layers 2, 3 when the two knitting areas 11, 12 have the lesser distance to one another and to only weave spacer threads 5 into the respectively other stitch rows a, c, e when the two covering layers 2, 3 have the respectively greater distance to one another.

Of course, it is also possible to achieve more than the two width regions 8, 9 illustrated and more than two different thicknesses.

An additional change in thickness in direction of production 6 is also possible.

Pile threads 14 which are not used in stitch rows a, c, e in width region 8 can be woven into one of the two covering layers 2, 3 or they can be arranged between the two covering layers 2, 3 in a floating or loose manner. Pile threads 14 that are not woven into covering layers 2, 3 in stitch rows b, d, fin width region 9 can also be arranged between the two covering layers 2, 3 in a loose or floating manner.

In particular, knitted fabric 1 can be used where shoe materials are used.

In FIG. 3, it is shown that the individual stitch rows a-f are alternatingly filled with varyingly long spacer threads 4, 5. Although this is advantageous, it is not mandatory. It is also possible to provide two or three stitch rows respectively with shorter pile threads and then in turn provide two or three stitch rows with longer pile threads.

A transition region 18 is provided between the two width regions 8, 9. This transition region 18 can be kept free of spacer threads. However, it is also possible to dispose the longer of the transition threads here. These transition threads are then slightly compressed, which is not problematic, however.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A knitted fabric comprising:

a first covering layer;

a second covering layer; and an arrangement of pile threads formed as spacer threads between the first covering layer and the second covering layer, wherein each covering layer comprises multiple stitch rows arranged one after another, wherein the spacer threads in a first width region have a different length than the spacer threads in a second width region, and wherein, for at least two adjacent stitch rows, a first stitch row is connected to spacer threads of a first length in the first width region and a second stitch row is connected to spacer threads of a second length in the second width region, whereby the spacer threads knitted into each stitch row have equal lengths.

2. The knitted fabric according to claim 1, wherein stitch rows having spacer threads of the first length and stitch rows having spacer threads of the second length alternate with one another.

3. The knitted fabric according to claim 1, further comprising a transition region arranged between the first width region and the second width region, which is free of spacer threads.

4. The knitted fabric according to claim 1, further comprising a transition region arranged between the first width region and the second width region, in which spacer threads having a length of a greater of the different lengths are arranged.

5. The knitted fabric according to claim 1, wherein the pile threads are respectively knitted into one of the covering layers in regions in which the pile threads do not connect the two covering layers.

6. The knitted fabric according to claim 1, wherein, at least in one predetermined length section of the knitted fabric, each stitch row comprises a width section that is free of spacer threads.

7. A method for producing a knitted fabric comprising:

producing a first covering layer with a series of first stitch rows arranged one after another in a direction of production and a second covering layer with a series of second stitch rows arranged one after another in the direction of production; and knitting pile threads arranged between the two covering layers into the covering layers as spacer threads, wherein a distance between the covering layers is not constant and regions having different length spacer threads are produced, wherein the spacer threads are knitted into a first width region at a first distance between the covering layers and the spacer threads are knitted into a second width region at a second distance between the covering layers.

8. The method according to claim 7, wherein the spacer threads are only knitted into a first width region at a first distance between the covering layers and the spacer threads are only knitted into a second width region at a second distance between the covering layers.

9. The method according to claim 7, wherein alternation occurs between the first distance and the second distance.

10. The method according to claim 9, wherein, at least on one predetermined length section of the knitted fabric, a different distance between the covering layers is set for each new stitch row.

11. The method according to claim 10, wherein, at least in the predetermined length section, one width section is formed without spacer threads in each stitch row.

12. The method according to one of claim 8, wherein pile threads which are not used as spacer threads in a width section are carried along in a covering layer.

13. A warp knitting machine comprising:

two knitting regions structured and arranged for producing respective one covering layers;

an actuating drive structured and arranged to adjust a distance between the knitting regions to produce at least first and second width regions between the covering layers having different thicknesses corresponding to the adjusted distance;

at least one pile guide bar having guide needles, the at least one pile guide bar being movable with the guide needles back and forth between the knitting regions; and a control device structured and arranged to adjust the guide needles depending on the distance between the knitting regions to knit first spacer threads in the first width region and second spacer threads in the second width region so that a length of the first spacer threads is different from a length of the second spacer threads, wherein, for at least two adjacent stitch rows, one stitch row is connected to the first spacer threads of the first length in the first width region and one stitch row is connected to the second spacer threads of the second length in the second width region, and wherein the at least one pile guide bar is formed as a jacquard guide bar, the guide needles of which are adjustable between a working position and a resting position.

14. The warp knitting machine according to claim 13, wherein the control device is further structured to control the actuating drive.

* * * * *